United States Patent [19]

Scheidt

[11] 4,214,432

[45] Jul. 29, 1980

[54] APPARATUS FOR FORMING S-Z TWISTED STRAND UNITS

[75] Inventor: Gerald A. Scheidt, Dunwoody, Ga.

[73] Assignee: Western Electric Company, Inc., New York, N.Y.

[21] Appl. No.: 972,105

[22] Filed: Dec. 21, 1978

[51] Int. Cl.[3] ..... H01B 13/04

[52] U.S. Cl. ..... 57/293; 57/294

[58] Field of Search ..... 57/293, 294

[56] References Cited

U.S. PATENT DOCUMENTS

| | | | |
|---|---|---|---|
| 3,052,079 | 9/1962 | Henning | 57/293 |
| 3,373,550 | 3/1968 | Symonds | 57/294 |
| 3,507,108 | 4/1970 | Yoshimura et al. | 57/294 |
| 3,643,411 | 2/1972 | Vogelsberg | 57/294 |
| 3,782,092 | 1/1974 | Vogelsberg | 57/294 |
| 3,808,787 | 5/1974 | Vogelsberg | 57/294 |
| 3,823,536 | 7/1974 | Vogelsberg et al. | 57/294 |
| 3,941,166 | 3/1976 | Maillefer | 57/294 X |
| 4,006,582 | 2/1977 | Gurkaynak et al. | 57/294 |

*Primary Examiner*—John Petrakes

*Attorney, Agent, or Firm*—Robert B. Kennedy

[57] ABSTRACT

Apparatus is disclosed for forming S-Z twisted strand units which comprises a frame and an elongated body mounted to the frame for rotation about a longitudinal body axis. The body is comprised of an assembly of tubules extending side by side longitudinally between opposite body ends. A first twisting head is rigidly mounted to one end of the elongated body which has a sheave mounted for rotary movement about a sheave axis transversing the longitudinal body axis. A second twisting head is rigidly mounted to the other end of the body having another sheave mounted for rotary movement about another sheave axis which transverses the longitudinal body axis. Means are also provided for rotating the elongated body in alternate directions about the longitudinal body axis. So constructed, strand units may be passed a plurality of times through the elongated body by routing the strand units through the body between the first and second twisting heads successively through the body without coming into contact with one another, and the body with its assembly of rotated in alternate directions thereby forming the strands into S-Z twisted strand units.

7 Claims, 8 Drawing Figures

APPARATUS FOR FORMING S-Z TWISTED STRAND UNITS

TECHNICAL FIELD

This invention relates to apparatuses for forming S-Z twisted strand units.

BACKGROUND OF THE INVENTION

In conventionally producing twisted strand pairs or quads of insulated conductors, such as those forming telecommunications cable, either a strand supply reel or a strand take-up reel has been revolved about the longitudinal axis of the strands to impart a unidirectional twist. More recently however methods have been devised for forming twisted strand units without the need for revolving the strand supply or take-up by periodically reversing the direction of strand twist imparted to an advancing group of strands. This has become known as S-Z twisting with S referring to left-hand twists and Z referring to right-hand twists. It is usually performed with apparatuses known as accumulators which have mutually spaced twisting heads. Each twisting head normally has one or more sheaves rotatably mounted to a head support which itself is mounted for revolution about the axis of two or more strands advancing side by side through the accumulator.

Heretofore many different types of accumulators have been developed which may be used in producing S-Z twisted strand units. One type is known as a variable storage accumulator, examples of which are disclosed in U.S. Pat. Nos. 3,373,550 and 3,782,092. A variation on this type is known as a variable capacity, in line accumulator, an example of which is shown in U.S. Pat. No. 3,052,079. Another type is termed a fixed storage accumulator which effects S-Z twisting by varying the speed of advance of the strands through the accumulator while maintaining the speed of revolution of the accumulator twisting heads constant about the strands. An example of this is shown in U.S. Pat. No. 3,507,108. A variation of the fixed storage type alters the relative speed of rotation of the twisting heads themselves while maintaining the speed of advance of the strands constant. Representative examples of these accumulators are disclosed in U.S. Pat. Nos. 3,823,536 and 4,006,582.

Most of the described accumulators have been quite complex and weighty with numerous moving parts. Recently, however, as shown in U.S. Pat. No. 3,941,166, yet another type of accumulator has been devised of simplified construction. It employs spaced twister heads mounted for synchronous movement about strands that are advanced at a constant line speed through a hollow tube which extends between the two twister heads. The twister heads and linking tube are driven as a unit in abruptly reversing directions about the strands forming them into S-Z twisted units having periodically spaced points of twist reversal. In operation the tube interior walls rotate with the strands and with the strand reversal points pressed by centrifugal force thereagainst without friction being caused by relative rotary movement between the strands and tube. The spacing between the heads dictates the spacing between the twist reversal points.

As it is functionally desirable to have as few reversal points as possible in any given length of twisted communications strands, it is also desirable to have the spacings and thus the tube itself be as long as possible. The length of the tube however is limited by several restricting factors such as available space for housing the accumulator, the moment of inertia created by abruptly reversing the direction of tube rotation, the various bearings required in supporting the tube, and the friction of the strands created by their progress through the tube. Heretofore there has been developed a method by which the spacing between twist reversal points may be increased without actually increasing the spacing between the twisting heads of an accumulator, an example of which is disclosed in U.S. Pat. No. 3,808,787. With this method, which is herein referred to as "tri-lap", strand units are passed three times between the spaced twister heads of the accumulator which effectively reduces by two thirds the spacing between the two twister heads required for a given spacing between twist reversal points. Conversely, for a given spacing between heads the spacing between twist reversal points is increased three fold.

Unfortunately, it has not been thought feasible to convert accumulators of the type having a tube through which the strand units are passed between twister heads for tri-lap operations. One principle reason for this is the substantial increase that would be created in the contact of twist reversal points with the tube and with the attendant friction thereby created. Furthermore, at least some of the strand units would apparently pass between the spaced twister heads in opposite directions. Were they to contact one another within the tube the twist reversal points would tend to unravel. It therefore would be desirable to devise still another type of accumulator that would posses both the benefits offered by the tri-lap method and the benefits of using a rotatable tube to the ends of which twister heads are mounted.

SUMMARY OF THE INVENTION

In one form of the invention apparatus is provided for forming S-Z twisting strand units which comprises a frame and an elongated body mounted to the frame for rotation about a longitudinal body axis. The body is comprises of an assembly of tubules extending side by side longitudinally between opposite body ends. A first twister head is rigidly mounted to one end of the body, and a second twisting head rigidly mounted to the other end of the body. Means are provided for rotating the body about the longitudinal body axis. So constructed, strand units may be passed a plurality of times through the elongated body by routing the strand units through the body between the first and second twisting heads successively through the tubules without strands moving in opposite directions through the body coming into contact with one another, and the body with its assembly of tubules rotated thereby forming the strands into S-Z twisted strand units.

In another form of the invention apparatus is provided for forming S-Z twisting strand units which comprises a frame and an elongated tube mounted to the frame for rotation about a longitudinal tube axis with the tube defining at least three channels extending between the tube ends. A first twisting head is rigidly mounted to one end of the tube having a plurality of sheaves mounted for rotation about mutually parallel sheave axis transversing the longitudinal tube axis, and a second twisting head rigidly mounted to the other end of the tube having a plurality of sheaves mounted for rotation about other mutually parallel sheave axes transversing the longitudinal tube axis. The apparatus further comprises means for rotating the tube about the longitudinal tube axis. So constructed, strand units may be passed at least three times through the tube with strand units routed from one sheave of the first twisting head through one tube channel to one sheave of the second twisting head through a second tube channel to another sheave of the first twisting head and through a third channel to another sheave of the second twisting head and be formed in S-Z twisted strand units upon rotation of the tube without strands moving in opposite directions coming into contact with one another.

DETAILED DESCRIPTION

Figure 1:
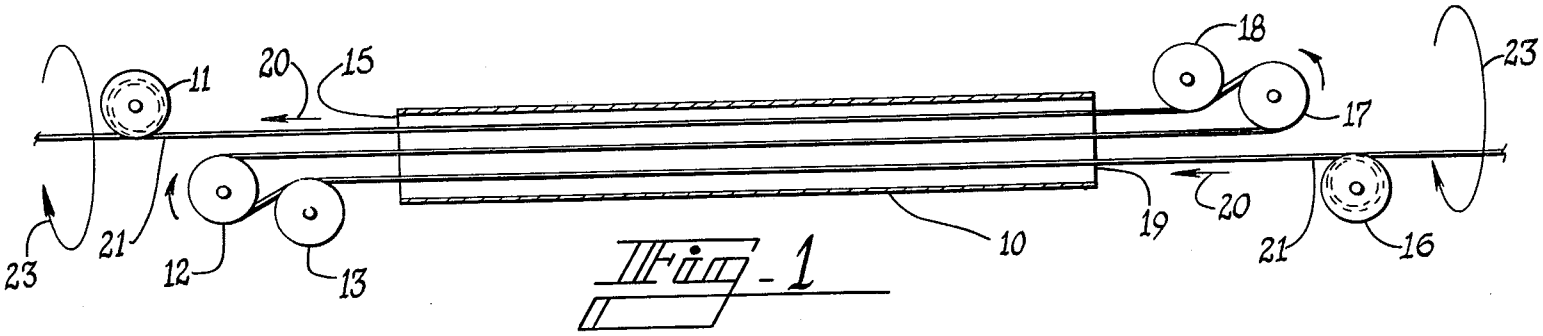
FIG. 1 is a schematic illustration explanatory of basic principles of the present invention.

Referring now to more detail to the drawing, there is schematically illustrated in FIG. 1 an accumulator for producing S-Z twisted strand units comprising a tube 10, three sheaves 11, 12, 13 mounted adjacent one tube end 15, and three other sheaves 16, 17 and 18 mounted adjacent the other tube end 19. A plurality of strands, such as a pair or a quad of insulated conductors, are routed through an unshown die towards the tube looped once about the sheave 16, through the tube passed over guide sheave 13 and looped about sheave 12, and then routed back through the tube. The strands are then looped about sheave 17, passed over guide sheave 18, and routed back through the tube where they are looped about sheave 11 and then depart the apparatus through another unshown die.

To effect a twisting operation the tube is rotated in one direction, as indicated by arrows 23, about its longitudinal axis causing the various sheaves which are mounted to the tube ends also to revolve about the tube axis. Simultaneously the strands are advance along their just described route in the direction indicated by arrow 20. This action imparts a twist to that portion of the advancing strands upstream from the accumulator between sheave 16 and the adjacent die unshown and to another portion located downstream from the accumulator between sheave 11 and the other adjacent unshown die. The rotation of the tube and the sheaves is continued in this direction until the leading edge of the twisted section created upstream the accumulator has passed about the sheave 16, three times through the tube, and reached sheave 11. At this time the assembly of tube and sheaves is brought to a halt while advance of the strands is continued at a constant rate of speed. This causes the twisted section of the strands to pass through the accumulator until the trailing end of the twisted section reaches sheave 11. At this time the tube and sheaves are again rotated about its longitudinal axis, preferably in a direction opposite to that indicated by arrows 21, whereupon a twist of opposite lay is imparted to the strands. This procedure is repeated indefinitely thereby forming the strands into twisted strand units of opposite lay from section to section. A more detailed explanation of this method whereby twisted strand sections are periodically passed through the accumulator with the accumulator motionless, except for the simple rolling motion of the sheaves, is provided in commonly assigned U.S. patent Application No. 957,772 filed Nov. 6, 1978, now U.S. Pat. No. 4,182,107. The advantage offered by a constant or alternate direction of twister heads rotations is also explained in this application.

Figure 4:
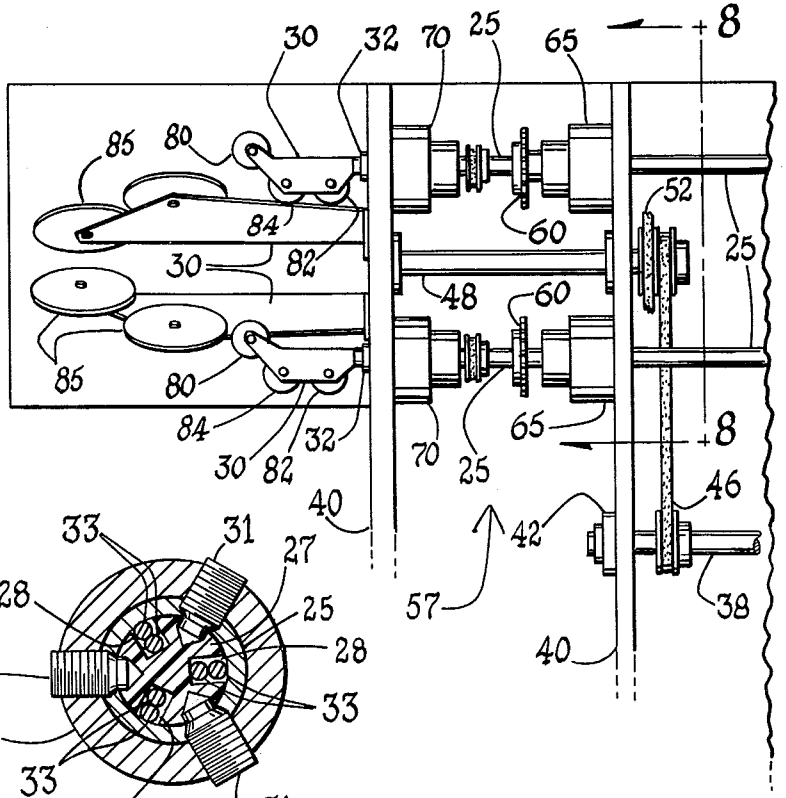
FIG. 4 is a transverse cross-sectional view of one of the four tubes of the apparatus shown in FIGS. 2 and 3.
Figure 4:
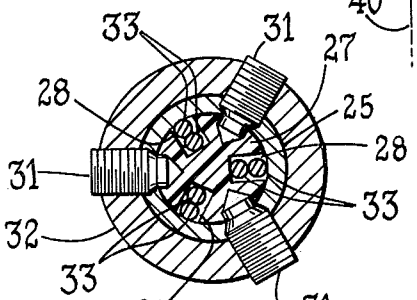

With reference next to FIGS. 2–8 apparatus embodying principles of the invention is shown in detail to comprise four tubes 25 which may be formed of stainless steel. Throughout the tube is snuggly seated a Teflon, cylindrical insert 27 having three longitudinal grooves radially spaced by 120° extending from one end of the tube to the other and which, together with the interior walls of the tube 25, define three channels or tubulets 28 as shown in FIG. 4. To each end of the tube is mounted by three set screws 31 a twister head comprising a support 30, a mounting collar 32 and three rotatable sheaves 80, 82 and 84. As indicated in the introductory explanation of the FIG. 1 schematic illustration, four pairs of insulation conductors 33 extend three times through the four tubes routed each time through one of the channels or tubulets 28 within a tube 25. Four individual tubes are employed in the apparatus here for simultaneously twisting four pairs or quads of wire strands together into twisted strand units. With four separate twisted strand units passing downstream from the apparatus they may be stranded together at a subsequent work station into a cable.

The four tubes 25 are driven by a power train now to be described. Power is initially transmitted to the apparatus from an unshown electric motor which revolves a belt 35 that is looped over a pulley secured to a jack shaft 38 mounted to frame 40 by bearings 42. Another pair of pulleys is also mounted to the jack shaft 38 about which are looped belts 46 which transmit power to two other jack shafts 48 which are mounted by bearings to the frame 40. Belts 52 transmit power from jack shafts 48 to four shafts 55 located in a regular twist section 57 and to four shafts 56 located in an overtwist section 58. A one to one ratio gear assembly 60 couples power from the shafts 55 to the tubes 25 through clutch modules 65 while another pair of one to one ratio gears 62 couple power from shafts 56 to the tubes 25 through clutch modules 66. Reverse direction coupling between the shafts 55 and the tubes 25 is also provided in the regular twist section be means of belts 68 which extend from the shafts 55 to clutch modules 70. Similarly, belts 72 provide reverse direction coupling in the overtwist section from shafts 56 to the tubes 25 via clutch modules 75.

Figure 5:
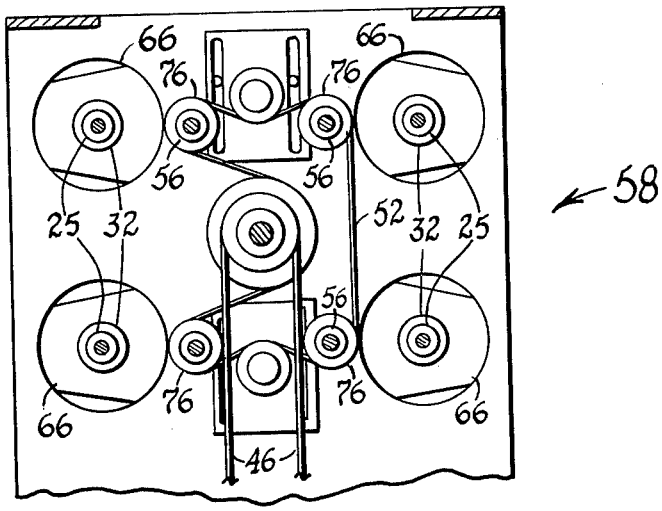
FIG. 5 is a cross-sectional view of the apparatus depicted in FIG. 3 taken along plane 5—5.
Figure 8:
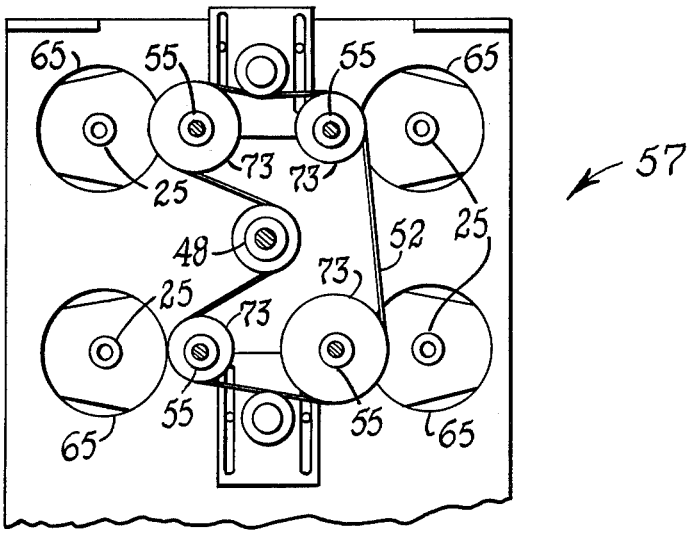
FIG. 8 is a cross-sectional view of the apparatus shown in FIG. 3 taken along plane 8—8.

In FIG. 8 it will be seen that one belt 52 couples power from shaft 48 to shafts 55 in the regular twist section through four pulleys 73 of mutually different root diameters. This is done to impart different twist lengths to each of the four strand units being simultaneously formed by the apparatus in order to reduce electrical cross-talk once the units are stranded into an operative communications cable. In FIG. 5 however it is seen that in the overtwist section the pulleys 76 attached to shafts 56 are of uniform diameter to impart a uniform overtwist to each of the stranded units.

Figure 2:
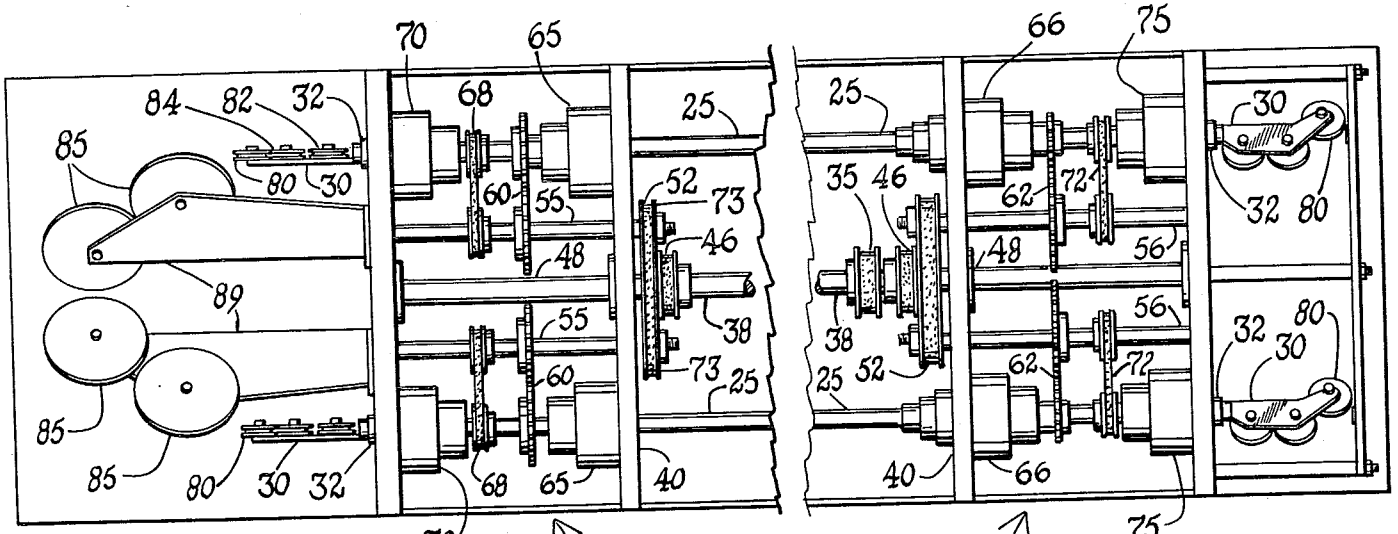
FIG. 2 is a plan view of apparatus embodying principles of the invention in one preferred form.
Figure 3:
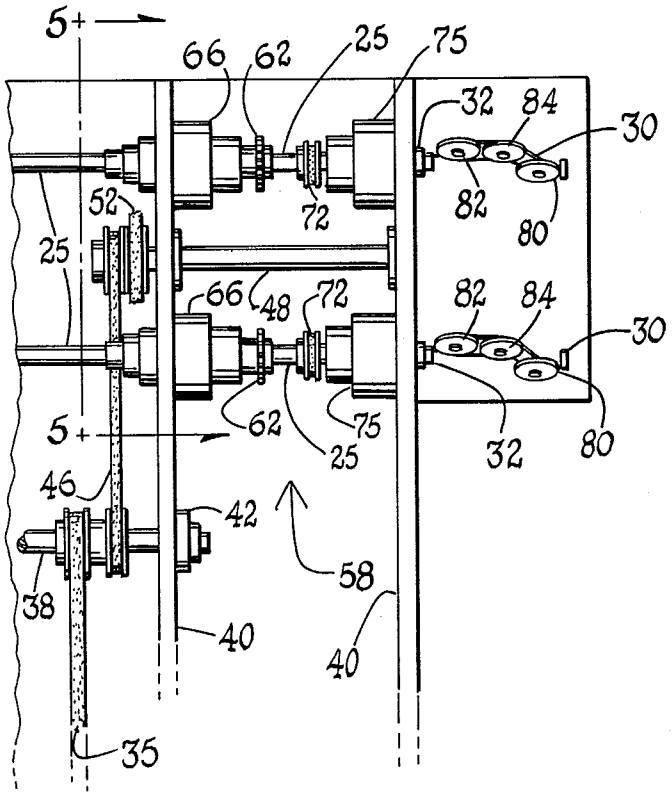
FIG. 3 is a side elevational view of the apparatus as shown in FIG. 2.
Figure 6:
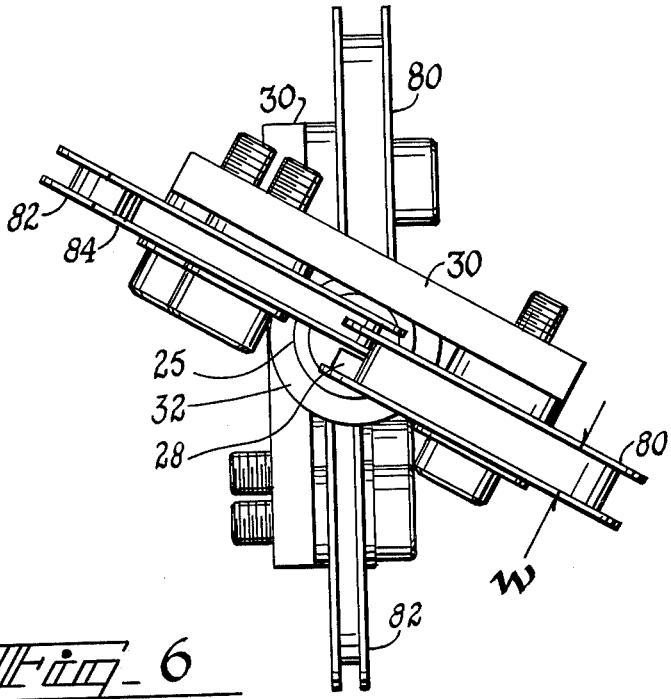
FIG. 6 is an end view of one of the twister heads shown in FIG. 2.
Figure 7:
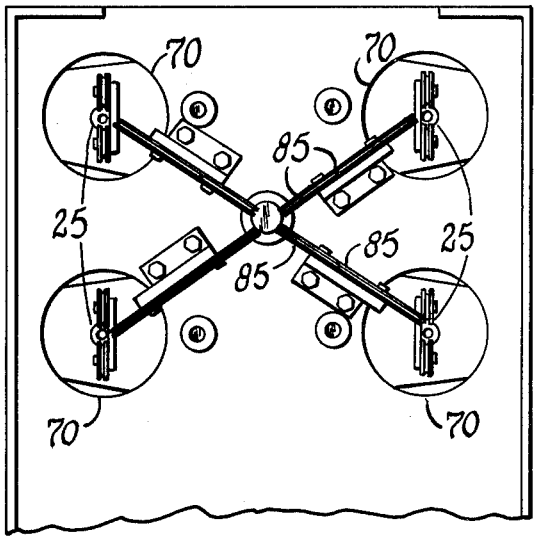
FIG. 7 is an end view of the apparatus depicted in FIG. 2 as viewed from the left end.

With reference to FIGS. 2, 4 and 6 each twister head is again seen to include three sheaves 80, 82 and 84 rotatably mounted to a support 30. The mounting of each sheave to its support, and the orientation of each support itself to the tube is such as to provide in-line passage of strands from the tube channels to the sheaves and from the sheaves away from the accumulator along the tube axis. In addition, the locations of the various sheaves is such as to preclude self contact with strand units as they pass through the accumulator.

In routing the strands through the accumulator an input pair or quad of insulated strands is first looped completely about a sheave 80 of a first twisting head then passed through a channel 28 of the tube 25. From FIG. 6 sheave 80 is seen to have groove width w sufficient to accomodate two pairs or quads side by side. It is also seen that this sheave is positioned to receive input strands along the axis of the tube 25, to have the strands looped once therearound at a slightly skewed angle, and then to depart the sheave on line for entry into a tube channel 28. In exiting the channel at the second, other twisting head the strands are passed over a guide sheave 82, looped about a sheave 84 and then routed back through the tube in another channel or tubelet 28. Again this is all done with in-line exit and entry by the strands between the channels and sheaves of the second twisting head which, from FIG. 6, are seen to be rotated 60° from the sheaves of the first twisting head. Back at the first twisting head the strands are passed over sheaves 82 and 84 and then routed back through a third channel in the tube 25. Once more the relative position of the tube channels and the sheaves permit in-line channel entry and exit. Furthermore, the fact that sheave 84 is located slightly closer to the axis of tube 25 inhibits strand units from making self contact. Finally, at the second twisting head the strands are looped about the other sheave 80, again having a groove width W, and depart the apparatus over a pair of relatively large guide sheaves 85 rotatably mounted to supports 89 fixedly secured to the frame 40.

After the strands have been routed through the apparatus as just described they are advanced at a constant speed to commence a twisting operation. Power is then applied to the clutches 65, 66, 70 and 75 via drive belts 35, 46, 52 and 68 and gears 60. Clutch modules 70 of the regular twist section 57 are then operated by an unshown control system to cause the tubes 25 and twisting heads secured thereto to rotate about the longitudinal tube axes. The tubes are rotated in one direction for the period of time required for a section of twists eminating from one twisting head to reach the other twisting head. Just before then the clutches 70 of the regular twist section are disengaged and clutches 75 of the overtwist section briefly engaged. The tube and twisting heads are then brought to a halt by unshown brake means until that section has passed through the tube. Just before the trailing edge of that section reaches the downstream twisting head clutch modules 66 of the overtwist section 58 are engaged causing a tighter twist or "overtwist" to be given to the strands at the twist reversal point. Then these clutches are disengaged and clutches of clutch modules 65 of the regular twist section engaged to impart a reverse, regular twist to the strands. When another section of twist approaches the downstream twising heads the clutches 65 are disengaged and clutches 66 of the overtwist section 58 engaged to impart an overtwist prior to the next pass through, at the end of which another overtwist is imparted and the cycle repeated indefinitely.

It thus is seen that an apparatus is provided for forming S-Z twisted strand units. Possessing the capability utilizing the tri-lap method of twisting, the apparatus is quite compact. Furthermore, used in the manner described, the tri-lap method may be employed without twist reversal points passing through the tubes and without strand units moving in opposite directions within the tube coming into mutual contact. In one particular case, the apparatus operating in this manner has provided a 3 inch regular twist, and a 1 inch overtwist to 12 foot twist sections.

It should be understood that the just described apparatus merely employs principles of the invention in one preferred form. Many modifications, additions and deletions may, of course, be made thereto without departure from the spirit and scope of the invention as set forth in the following claims.

What is claimed is:

1. Apparatus for forming S-Z twisted strand units comprising a frame; an elongated body mounted to said frame for rotation about a longitudinal body axis and being comprised of an assembly of at least three tubules located radially about said body axis extending side by side longitudinally between opposite body ends; a first strands twisting head rigidly mounted to one end of said elongated body and a second strands twisting head rigidly mounted to the other end of said elongated body with each of said strands twisting heads having a plurality of sheaves each provided with an annular groove; and wherein the sheaves of each twisting head are mounted for rotary movement about mutual parallel axes with each sheave being aligned to receive strands extending linearily through a different one of said tubules with the groove of at least one sheave of each twisting head being partially offset axially from the groove of an adjacent sheave; and means for rotating said elongated body and said first and second strands twisting heads about said longitudinal body axis whereby strand units may be passed a plurality of times through the elongated body by routing the strand units through the body between the first and second twisting heads successively through the tubules without strand units moving in opposite directions through the body coming into contact with one another or with the body ends, and the body with its assembly of tubules rotated about the longitudinal body axis thereby forming the strands into S-Z twisted strand units.

2. Apparatus for forming S-Z twisted strand units in accordance with claim 1 wherein said sheaves of said first twisting head are mounted for rotary movement about mutually parallel first axes, and wherein said sheaves of said second twisting head are mounted for rotary movement about mutually parallel second axes.

3. Apparatus for forming S-Z twisted strand units in accordance with claim 1 wherein said elongated body is cylindrical and wherein said tubules are located along equally spaced radials of said cylindrical body about said cylindrical body axis, whereby upon rotation of said cylindrical body said tubules revolve about said cylindrical body axis.

4. Apparatus for forming S-Z twisted strand units comprising a frame; an elongated tube mounted to said frame for rotation about a longitudinal tube axis with the tube defining at least three channels extending between the tube ends; a first twisting head rigidly mounted to one end of said tube having a plurality of sheaves mounted for rotation about first mutually parallel sheave axes transversing said longitudinal tube axis; a second twisting head rigidly mounted to the other end of said tube having a plurality of sheaves mounted for rotation about second mutually parallel sheave axes transversing said longitudinal tube axis radially offset from said first sheave axes; and means for rotating said tube about said longitudinal tube axis; whereby strand units may be passed at least three times through the tube with strand units routed from one sheave of the first twisting head through one tube channel to one sheave of the second twisting head through a second tube channel to another sheave of the first twisting head and through a third tube channel to another sheave of the second twisting head and be formed into S-Z twisted strand units upon rotation of the tube without strands moving in opposite directions coming into contact with one another.

5. Apparatus for forming S-Z twisted strand units in accordance with claim 4 wherein said channels extend linearily through said tube closely adjacent said tube axis, and wherein each sheave of said first twisting head has an annular groove aligned with a mutually different one of said three linear channels, and wherein each sheave of said second twisting head has an annular groove aligned with a mutually different one of said three linear channels.

6. Apparatus for forming S-Z twisted strand units in accordance with claim 1 wherein the sheave axes of said first strands twisting head are nonparallel with the sheave axes of said second strands twisting head.

7. Apparatus for forming S-Z twisted strand units in accordance with claim 6 wherein said tubules number three and wherein the axes of said first and second twisting heads are mutually offset 120°.

* * * * *